United States Patent [19]

Yamamoto et al.

[11] Patent Number: 4,958,610

[45] Date of Patent: Sep. 25, 1990

[54] FUEL INJECTION SYSTEM

[75] Inventors: Tadahiro Yamamoto; Ken Ota, both of Yokosuka, Japan

[73] Assignee: Nissan Motor Company, Ltd., Japan

[21] Appl. No.: 295,620

[22] Filed: Jan. 10, 1989

[30] Foreign Application Priority Data

Jan. 11, 1988 [JP] Japan ..... 63-3320

[51] Int. Cl.[5] ..... F02M 51/04; F02M 41/02; F02M 57/02

[52] U.S. Cl. ..... 123/478; 123/498

[58] Field of Search ..... 123/472, 498, 478, 446

[56] References Cited

U.S. PATENT DOCUMENTS

| | | | |
|---|---|---|---|
| 3,575,145 | 11/1968 | Steiger | 123/357 |
| 3,592,177 | 7/1971 | Wehde | 123/446 |
| 3,851,635 | 12/1974 | Murtin et al. | 123/478 |
| 3,983,855 | 10/1976 | Jarrett | 123/498 |
| 4,073,276 | 2/1978 | Nicolls | 123/139 |
| 4,475,507 | 10/1984 | Miyaki et al. | 123/357 |
| 4,633,837 | 1/1987 | Babitzka et al. | 123/478 |
| 4,635,849 | 1/1987 | Igashira et al. | 239/102.2 |
| 4,821,726 | 4/1989 | Tamura et al. | 123/498 |
| 4,887,569 | 12/1989 | Igashira et al. | 123/498 |

FOREIGN PATENT DOCUMENTS

| | | |
|---|---|---|
| 0055117A2 | 6/1982 | European Pat. Off. . |
| 58-210357 | 6/1982 | Japan . |

OTHER PUBLICATIONS

Automotive Engineering, No. 5 Diesel Engine, published Mar. 20, 1980 by Sankai-Do.

*Primary Examiner*—Tony M. Argenbright
*Assistant Examiner*—Robert E. Mates
*Attorney, Agent, or Firm*—Lowe, Price, LeBlanc, Becker & Shur

[57] ABSTRACT

A fuel injection system according to the present invention comprises a plunger disposed in a cylinder, an actuator in the form of a piezoelectric element for effecting reciprocation of the plunger, a fuel supply passage for admitting fuel to the cylinder, a plurality of pressurized fuel delivery passages for distributing pressurized fuel among a plurality of injection valves, solenoid valves for opening or closing the plurality of pressurized fuel delivery passages, and a control circuit for activating the actuator and the solenoid valves.

9 Claims, 4 Drawing Sheets

FUEL INJECTION SYSTEM

BACKGROUND OF THE INVENTION

The present invention relates to a fuel injection system for an internal combustion engine.

There is known a fuel injection pump of the distribution type (reference is made to a published book "AUTOMOTIVE ENGINEERING, NO. 5 DIESEL ENGINE" published on Mar. 20, 1980 by SANKAI-DO) as a typical example of conventional fuel injection systems for a diesel engine.

This is explained referring to FIG. 5. Supply of fuel is effected via an inlet 1 by a feed pump 3 driven by a drive shaft 2 coupled with an output shaft of an engine.

Fuel discharged out of the pump 3 with its pressure being regulated by a pressure regulator valve 18 is supplied to a pump chamber 5 of a pump housing 31.

The fuel within the pump chamber 5 is used for lubrication of moving portions and delivered to a high pressure plunger pump 6 via an admission port 12.

This pump has a plunger 7 which is fixedly secured to a cam disc 8 operatively coupled with a drive shaft 2 such that it is driven via a joint 2A by the drive shaft 2 in timed with the engine revolution speed.

The cam disc 8 has a plurality of face cams, corresponding in number to the number of cylinders of the engine, and it is lifted when one of the face cams 9 rides over a roller 11 rotatable with a roller ring 10. Thus, it reciprocates through a stroke determined by a cam lift.

Thus, the plunger 7 reciprocates while turning about its axis. This reciprocating movement causes fuel coming into via the admission port 12 to be supplied via a distribution port 13 and a delivery valve 14 to a fuel injection nozzle, not shown.

Fuel injection amount is adjusted by axially displacing a control sleeve 16 covering a cut-off port 15 formed in the plunger 7. For example, when the opening of the cut-off port 15 is uncovered by the control sleeve 16 owing to its rightward axial displacement, as viewed in FIG. 5, of the plunger 7, fuel supplied under pressure from a high pressure chamber 6A to the distribution port 13 is discharged toward the pump chamber 5 where a relatively low pressure builds up via the cut-off port 15, causing termination of supply of fuel to the distribution port 13.

Therefore, if the control sleeve 16 is displaced to the right as viewed in FIG. 5 relative to the plunger 7, the termination of fuel injection takes place at a delayed timing, resulting in an increase in amount of fuel injection, whereas if the control sleeve 16 is displaced to the left as viewed in FIG. 5 relative to the plunger 7, the timing at which the fuel injection terminates is advanced, resulting in a decrease in amount of fuel injection.

The control sleeve 16 is mounted on a link lever assembly 19 cooperating with an accelerator pedal such that it is displaced in response to the amount of depression of the accelerator pedal. Concurrently, a governor mechanism 18 driven by the drive shaft 2 effects a correction on the link lever assembly 19, adjusting the amount of fuel injection in such a manner as to keep engine revolution speed at a predetermined constant value corresponding to a depression degree of the accelerator pedal.

This link lever assembly 19 includes a collector lever 21, a tension lever 22, a start lever 23, and a start spring 24.

The collector lever 21 is mounted on a pump housing 31 about a pivot B, and it is biased by a compression spring 25 into pressing engagemet with a full load adjust screw 26.

The tension lever 2 and start lever 23 are rotatably arranged about a pivot A. The tension lever 22 is subject to a bias force of a tension spring 28 which is varied via a control shaft 27 by a control lever 20 as the control lever 22 rotates. This bias force is transmitted to the start lever 23 via the start spring 24, urging the start lever 23 into pressing engagement with a governor sleeve 18*f* of the governor mechanism 18.

The above-mentioned control sleeve 16 is supported by the start lever 23 via a ball joint 18*g*.

Therefore, turning the lever 20 in such a direction as to increase tension of a spring 28 causes the tension lever 22 to rotate in a counterclockwise direction, as viewed in FIG. 5, causing the start spring 24 to bias the start lever 23 to rotate counterclockwise, as viewed in FIG. 5, about the pivot A, displacing the control sleeve 16 to the right as viewed in FIG. 5, resulting in an increase in the amount of fuel injection.

The governor mechanism 18 is contained within a main body of the fuel pump at its upper portion, and includes a gear 18*a* integrally connected to a weight holder 18*b* to which weights 18*c* are connected for rotation about connection points 18*d*. If the weight holder 18*b* rotates about the governor shaft 18*e* in response to rotation of the drive shaft 2, the weights 18*c* rotate also and spread about their connection points 18*d* due to centrifugal force. For example, if, with the same accelerator depression degree, the engine revolution speed increases, the governor sleeve 18*f* is pressed to the right and advances toward the start lever 23 since it is coupled with the governor shaft 18*e* and engaged with the weights 18*c*. This advancing movement of the governor sleeve 18*f* causes the start lever 23 to rotate clockwise about the pivot A against the bias of the start spring 24, causing the control sleeve 16 to move to the left as viewed in FIG. 5, resulting in a decrease in the fuel injection amount. This causes a drop in engine revolution speed toward an engine revolution speed value corresponding to a given accelerator depression degree.

The fuel injection timing is controlled by rotating the roller ring 10.

Concretely, since the fuel is injected when each of the face cams 9 of the cam disc 8 rides over the roller 11, if the roller ring 10 rotates, for example, in a direction in opposite to a direction which the cam disc 8 is rotated, the timing at which the face cam 9 rides over the roller 11 is advanced accordingly, so that the fuel injection timing is advanced with respect to the engine crank angle.

The roller ring 10 has a timer slide pin 29 engaged in a timer piston 30 so that it is rotated as the timer piston 30 slides.

The timer piston 30 is slidably disposed in a cylinder 30A to define a high pressure chamber 32 adjacent to one end face thereof, and a low pressure chamber 34 adjacent to the opposite end face thereof. Fuel pressure is admitted to the high pressure chamber 32 via a passage 33 from the pump chamber 5, while the low pressure chamber 34 communicates with the suction side of the feed pump 3, so that the pressure within this chamber is as low as a vacuum pressure. However, the bias force of a spring 35 disposed in the lower chamber 34 pushes the timer piston 30 back toward the high pressure chamber 32. In FIG. 5, the timer piston 30 is illustrated in a position where its axis turned through 90 degrees from its original position although the axis of the timer piston 30 extends in a tangential direction to the rotation of the roller 10. Similarly, for ease of illustration, the axis of the feed pump 3 illustrated in FIG. 5 has been turned through 90 degrees from its actual position.

The fuel pressure in the pump chamber 5 increase in proportion to revolution speed of the feed pump 3, so that the timer piston 30 is biased to move to the left, as viewed in FIG. 5, in response to an increae in engine revolution speed. This causes the roller ring 10 to rotate in a direction opposite to a direction which the cam disc 8 rotates in, resulting in advancement of the fuel injection timing relative to the engine crank angle.

However, the conventional fuel injection system mentioned previously employs a mechanical construction to control a fuel injection amount and an injection timing, so that the mechanical construction inevitably becomes complicated, making assembly of component parts and subsequent adjustment thereof difficult. Since the precision degree of machining a cam disc or the like has a limit, there occur variations of fuel injection amount among different cylinders, so that it is difficult to provide stable engine operation at idling. The fuel injection amount is determined by its duration. The duration is decreased when it is desired to decrease fuel injection amount. This, however, does not necessarily provide fuel supply characteristic which is fit for running condition. For example, this results in providing a poor exhaust gas composition during operation with low load. Besides, the conventional fuel injection system is heavy, and requires increased cost, thus hampering wide spread of diesel engine mounted passenger cars.

The present invention aims at providing a superior fuel injection system which has solved the above mentioned problems.

SUMMARY OF THE INVENTION

According to the present invention, there is provided a fuel injection system including a plurality of fuel injection valves, the fuel injection system comprising:

means defining a cylinder;

a plunger disposed in said cylinder;

actuator means for reciprocating said plunger in said cylinder;

means for defining a fuel supply passage for admitting fuel to said cylinder;

means fordefining a plurality of fuel delivery passages communicating with said cylinder for distributing fuel among the plurality of injection valves;

solenoid valve means for opening or closing said plurality of fuel delivery passages, respectively; and means for controlling said actuator, means and said solenoid valve means.

In one form of the present invention, the actuator means includes a piezoelectric element.

The controlling means generate a drive signal to the actutator means in the form of the piezoelectric element, causing the actuator to extend or contract, thus reciprocating the plunger in the cylinder. This reciprocating movement of the plunger causes induction of fuel into the cylinder via the fuel supply passage, compression thereof to cause discharge of fuel out of the cylinder under high pressure. The fuel discharged under high pressure is supplied to the corresponding one of the fuel injection valves through the corresponding one of the pressurized fuel delivery passages which is opened by the solenoid valve means, causing fuel injection.

Since the fuel injection system according to the present invention uses the actuator means of the quick-responsive type and the plurality of solenoid valves, with a simple construction, the fuel injection amount, injection duration and injection timing can be easily and accurately controlled by electrically controlling the actuator means and the solenoid valve means.

Accordingly, an object of the present invention is to provide a fuel injection system less complicated in construction and having increased accuracy in controlling fuel injection amount, injection duration and injection timing.

DETAILED DESCRIPTION OF THE INVENTION

Figure 1:
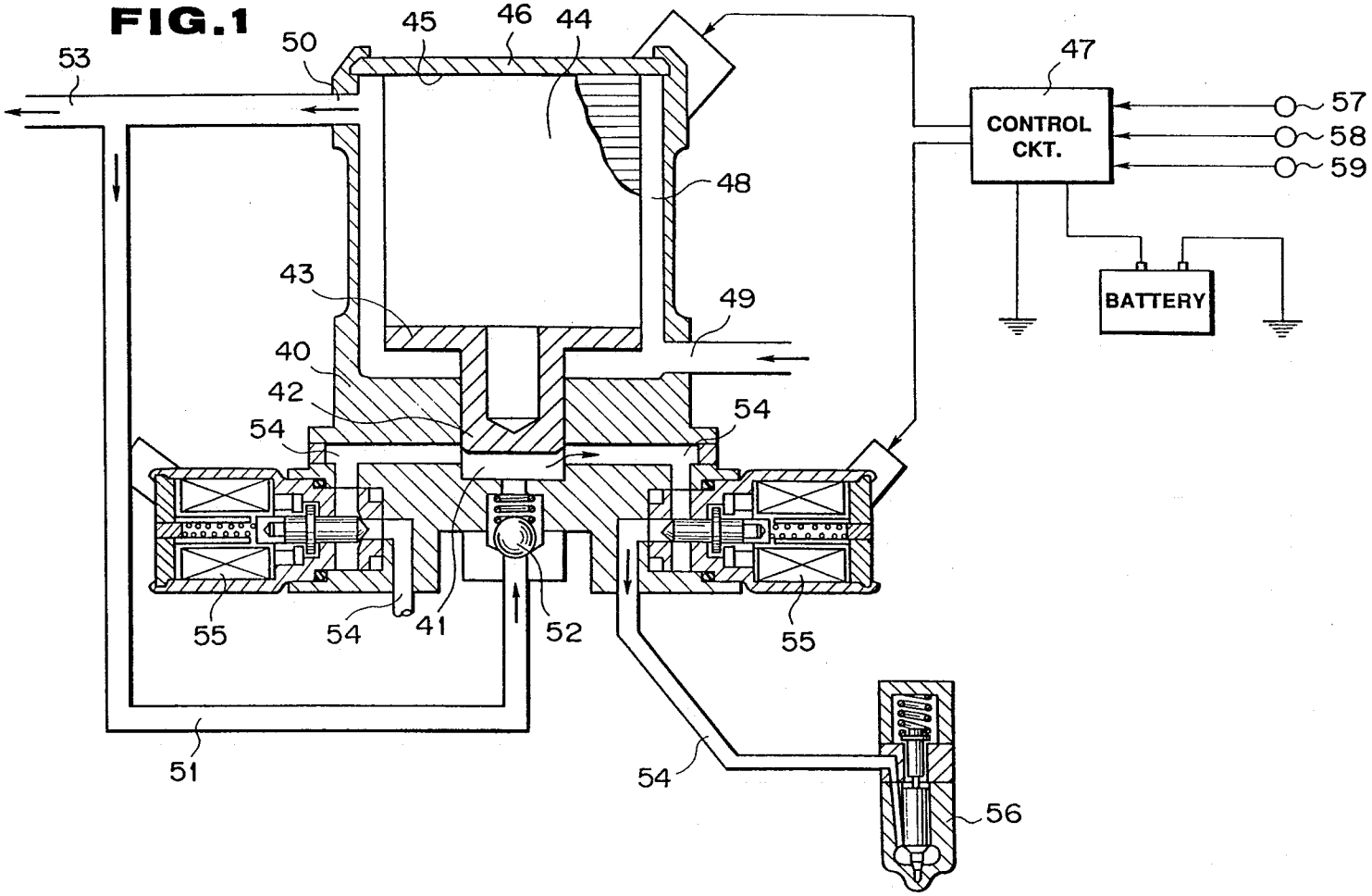
FIG. 1 is a sectional diagram of an embodiment according to the present invention.

Referring to FIG. 1, a pump body 40 is formed with a cylinder 41. Slidably received in the cylinder 41 is a plunger 42 having one end formed with a flange-like base 43 which is coupled with an actuator 44 mounted on the pump body 40.

Figure 2:
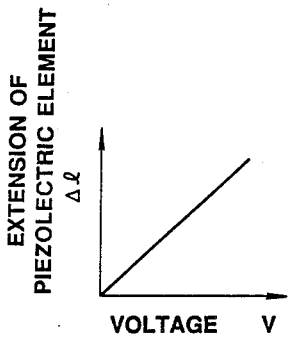
FIG. 2 is a chart illustrating characteristic performance of an actuator.

The actuator 44 is of the quick response type and is constructed of a piezoelectric element of the laminated type and includes a base end 45 secured to a rear plate 46 of the pump body 40. In response to a drive signal supplied from a control circuit 47 (which will be later described), the actuator 44 extends or contracts in response to the magnitude of electric voltage of the drive signal in accordance with a characteristic as shown in FIG. 2, causing the plunger 42 to reciprocate in the cylinder 41.

Around the actuator 44 is an annular passage 48 which is defined between the actuator 44 and the pump body 40. The annular passage 48 has a fuel inlet 49 which fuel from a fuel tank, not shown, to be delivered to the annular passage 48 passes through. Via an outlet 50 that is disposed on a side opposite to the side in which the inlet 49 is formed, the annular passage 48 is connected to a fuel supply passage 51 and then to the before-mentioned cylinder 41. Provided between the fuel supply passage 51 and the cylinder 41 is a reverse flow check valve 52. A fuel return passage 53 is connected to the fuel supply passage 51 to return the excessive fuel.

Connected to and extending diametrically from the cylinder 41 are a plurality of pressurized fuel delivery passages 54 with which the valve body 40 is formed. Provided in each of the pressurized fuel delivery passages 54 is a solenoid valve 55.

The number of the pressurized fuel delivery passages 54 and solenoid valves 55 correspond to the number of fuel injection valves 56. The pressurized fuel delivery passages 54 are connected to the corresponding fuel injection valves 56 at portion downstream of the solenoid valves 55, respectively.

The reference numeral 47 denotes the control circuit which controls activation of the actuator 44 and the solenoid valves 55. Supplied to this control circuit 47 are a signal from a revolution speed sensor which detects the engine revolution speed, a signal from an accelerator position sensor 58 which detects the position of an accelerator, and a signal from a camshaft angle sensor 59 (which may be replaced with a crank angle sensor). Based on the input signals, the control circuit 47 controls activation of the actuator 44 and the solenoid valves 55.

Figure 3:
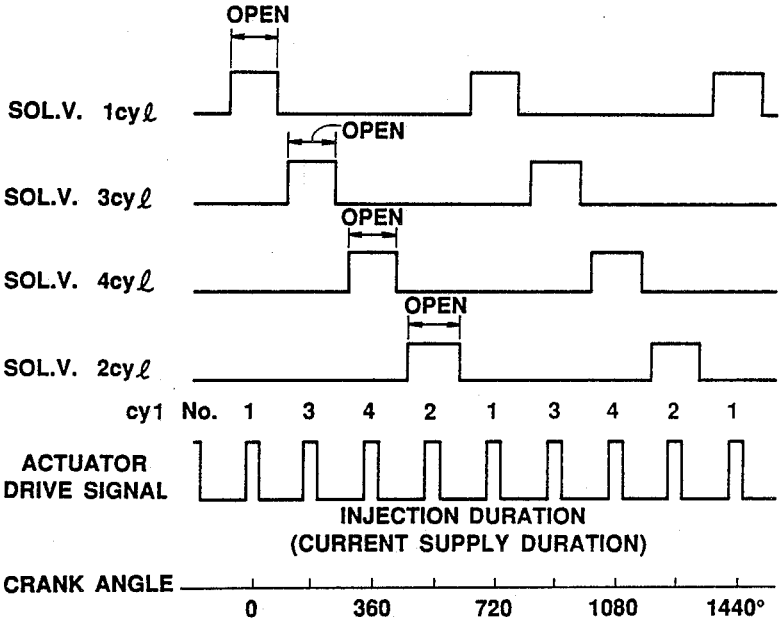
FIG. 3 is a timing chart.

The control strategy by the control circuit 47 is such that the corresponding one of the solenoid valves 55 to a cylinder is opened when a piston in the cylinder moves through a period expressed by $\pm CA°$ with respect to the compression top dead center (for example $\pm 50°$ expressed in terms of crank angle). The control strategy of the actuator 44 is such that when a piston in one of the cylinders approaches its compression dead center, the actuator 44 begins to be activated at a predetermined angle, and kept activated from a predetermiend period of time with a drive signal with a predetermined electric voltage in such a manner as to inject an appropriate amount of fuel at an appropriate timing which matches the running conditions in which the vehicle is involved. FIG. 3 shows a timing chart of the above-mentioned control strategy as being applied to the four cylinder internal combustion engine.

The magnitude of electric voltage V of the drive signal supplied to the actuator 44 can be expressed by the following equation if the engine revolution speed is represented by N and the accelerator position $\alpha$ (alpha):

$$V = K \cdot N \cdot \alpha + Vd.$$

where, K is a constant, and Vd a reactive electric voltage. Values of V determined by the above equation versus various combinations of engine revolution speed N and the accelerator position $\alpha$ (alpha) are arranged in a map stored in a ROM of the control circuit 47.

Figure 4:
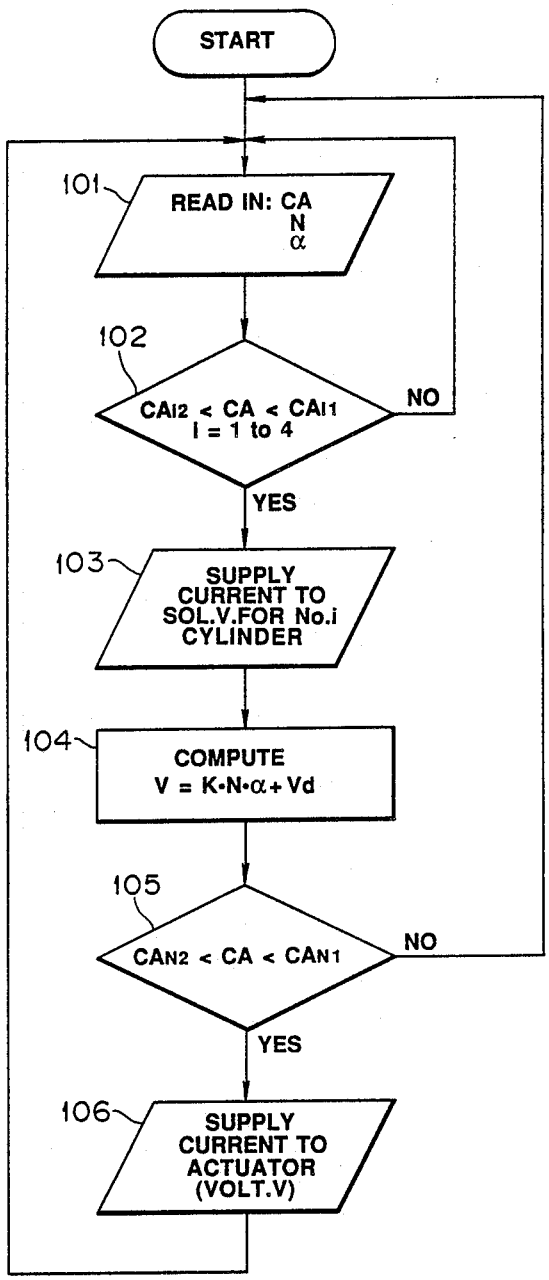
FIG. 4 is a flow chart.
Figure 5:
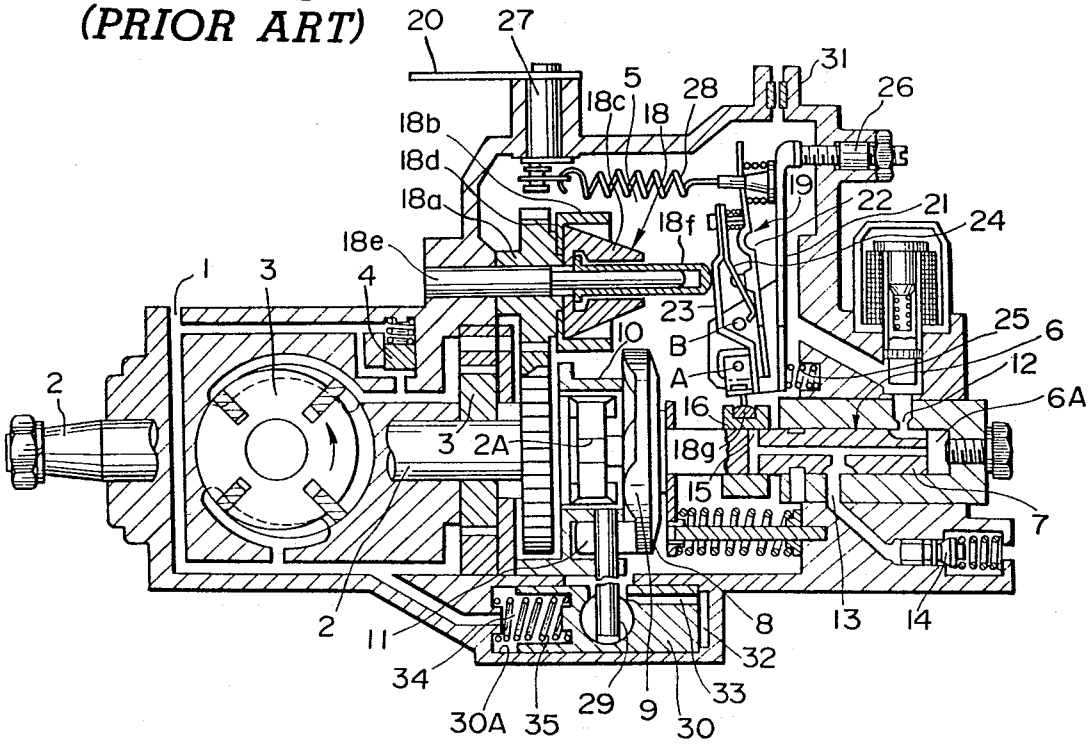
FIG. 5 (PRIOR ART)
FIG. 5 is a sectional diagram of the prior art previously discussed.

As shown in FIG. 4, when a position of a piston of one of the cylinders falls in a predetermined cam shaft angle range ($CAi_2 \sim CAi_1$) around the compression dead center of the piston, the corresponding solenoid valve 55 is opened (steps 102 and 103), and when it becomes a predetermined cam shaft angle $CA_{N2}$, a drive signal with a predetermined electric voltage V is supplied to the actuator 44, thereby to activate the actuator 44 (steps 104 to 106).

Activation of the actuator 44 causes the plunger 42 to project deeper into the cylinder 41, pressurizing the fuel within the cylinder 41 and deliver under pressure the fuel out of the cylinder 41 toward the corresponding fuel injection valve 56 via the corresponding solenoid valve 55 which is opened and the corresponding pressurized fuel delivery passage 54, inducting fuel injection.

When the position of the piston becomes equal to a cam shaft angle $CA_{N1}$, the supply of drive signal to the actuator 44 is cut off (steps 104 to 106); terminating the fuel injection. Concurrently, contraction of the actuator 44 causes the plunger 42 to retard out of the cylinder 41 so that a reduction in pressure within the cylinder 41 induces fuel thereinto from the fuel supply passage 51 via the reverse flow check valve 52.

As previously described, with a simple structure using an actuator 44 in the form of piezoelectric element and a plurality of solenoid valves 55 arranged to open/close the corresponding pressurized fuel delivery passage 54, the fuel injection is conducted. Thus, the assembly of the various component parts and the subsequent adjustment become easy, and the size and weight of the system are reduced, resulting in a considerable cost reduction.

Besides, the precision degree of the machining process of various component parts is enhanced since the matching process of them becomes easy, and unequal distribution of pressurized fuel is prevented since the fuel distribution is conducted through the fuel delivery passages 54 under the control of solenoid valves 55, so that even distribution of fuel among the engine cylinders is assured.

Since the extension movement of the actuator 44 is controlled by the drive signal from the control circuit 47, a good response characteristic is assured. As a result, the fuel injection timing can be appropriately controlled to the optimum timing by the control circuit 47 in response to various engine operating conditions.

The actuator 44 extends linearly in accordance with the magnitude of electric voltage of the drive signal and the amount of fuel is injected which is proportional to the amount of stroke of the plunger 42. Thus, the amount to be injected is easily controlled by adjusting the magnitude of the electric voltage of the drive signal and timing of termination of the drive signal, so that accurate fuel injection control is provided. Particularly, the amount of fuel to be injected and the timing of fuel injection are controllable by varying the magnitude of electric voltage of the drive signal and the termination timing of the drive signal. Thus, it is possible to elongate the fuel injection duration during operation with low load so as to improve exhuast gas compositions.

Beside, since the fuel injection amount and fuel injection timing are controlled by the actuator 44 only, the solenoid valves 55 provided in the fuel delivery passages 54 may take the form of an ordinary solenoid valve with a relatively slow response characteristic.

If the setting is made such that the cross section of the piezoelectric element is 3000 $mm^2$ and the maximum stroke of the actuator is 100 $\mu m$ (micron meter), it is confirmed by experiment that the fuel injection is conducted with a pressure above 200 $kg/cm^2$ and with the maximum volume of 50 $mm^3$.

According to the present invention as previously described, since an actuator in the form of a piezoelectric element is used to drive a plunger and a plurality of solenoid valves disposed in pressurized fuel delivery passages, respectively, to open or close them thereby to distribute fuel between fuel injection valves, there is provided a fuel injection system with a simplified construction, with reduced weight, with easy installation and subsequent adjustment, with reduced cost, with little performance distribution among manufactured final products, with superior controllability, with capability to provide appropriate fuel injection amount and timing.

What is claimed is:

1. A fuel injection system including a plurality of fuel injection valves and a fuel tank, the fuel injection system comprising:

a pump body formed with a cylinder and including a cylindrical wall and an end wall which cooperate with each other to define said cylinder;

a plunger slidably disposed in said cylinder;

an actuator mounted within said pump body, said actuator comprising a piezoelectric element of a laminated type and so constructed and arranged as to reciprocate said plunger in said cylinder as said actuator extends and contracts;

means for providing a fuel return passage having one end communicating with said pump body and an opposite end communicating with the fuel tank;

means for providing a fuel supply passage having one end connected to said fuel return passage and an opposite end communicating with said cylinder;

means for preventing fuel from flowing out of said cylinder toward said fuel return passage through said fuel supply passage;

said pump body being formed with a plurality of fuel delivery passages having one end thereof communicating with said cylinder;

a plurality, corresponding in number to said plurality of fuel delivery passages, of solenoid valves mounted to said pump body to close said plurality of fuel delivery passages, respectively; and means for controlling said actuator and said plurality of solenoid valves.

2. A fuel injection system as claimed in claim 1, wherein said actuator has a quick response characteristic, while said plurality of solenoid valves have a slow response characteristic.

3. A fuel injection system as claimed in claim 1, wherein said controlling means supply different drive signals to said actuator and said plurality of solenoid valves at different timings.

4. A fuel injection system as claimed in claim 1, wherein said pump body includes a fuel delivery passage having one end communicating with said cylinder at said end wall thereof, and said plurality of fuel delivery passages having one end communicating with said cylinder at said cylindrical wall thereof.

5. A fuel pump for an engine, comprising:

a pump body formed with a cylinder and including a cylindrical wall and an end wall which cooperate with each other to define said cylinder;

a plunger slidably disposed in said cylinder;

an actuator mounted within said pump body, said actuator being made ofa laminated structure of piezoelectric elements and so constructed and arrangeed as to urge said plunger to move in said cylinder toward and away from said end wall as said actuator extends and contracts, said actuator defining an annular passage within said pump body;

said pump body being formed with a fuel inlet communicating with said annular passage and a fuel outlet communicating with said annular passage, said fuel inlet being adapted to be connected to a fuel tank;

means for defining a fuel supply passage having one end connected to said fuel outlet and an opposite end communicating with the cylinder;

a reverse flow check valve mounted to said pump body and disposed in said fuel supply passage adjacent to said opposite end, said reverse flow check valve being so constructed and arranged as to prevent flow of fuel out of said cylinder toward said fuel supply passage during movement of said plunger toward said end wall, but to allow flow of fuel into said cylinder out of said fuel supply passage during movement of said plunger away from said end wall; and a plurality of fuel delivery passages formed in said pump body, each having one end communicating with said cylinder.

6. A fuel pump as recited in claim 5, further comprising a plurality of solenoid vavles mounted to said pump body to close said plurality of fuel delivery passages, respectively, corresponding in number to said plurality of fuel delivery passages.

7. A fuel pump as recited in claim 5, further comprising means for providing a fuel return passage having one end connected to said means for defining said fuel supply passage.

8. A fuel injection system including a plurality of fuel injector valves;

a fuel pump, comprising:

a pump body formed with a cylinder and including a cylindrical wall and an end wall which cooperate with each other to define said cylinder;

a plunger slidably disposed in said cylinder;

an actuator mounted within said pump body, said actuator being made of a laminated structure of piezoelectric elements and so constructed and arranged as to urge said plunger to move in said cylinder toward and away from said end wall as said actuator extends and contracts, said actuator defining an annular passage within said pump body;

said pump body being formed with a fuel inlet communicating with said annular passage and a fuel outlet communicating with said annular passage, said fuel inlet being adapted to be connected to means for delivering fuel from a fuel tank;

means for providing a fuel supply passage having one end connected to said fuel outlet and an opposite end communicating with said cylinder;

a reverse flow check valve mounted to said pump body and disposed in said fuel supply passage adjacent to said opposite end, said reverse flow check valve being so constructed and arranged as to prevent flow of fuel out of said cylinder toward said fuel supply passage during movement of said plunger toward the end wall, but to allow flow of fuel into said cylinder out of said fuel supply passage during movement of said plunger away from said end wall;

said pump body being formed with a plurality of fuel delivery passages each having one end communicating with sad cylinder and the opposite ends connected to the plurality of fuel injectors, repsectively;

a plurality of solenoid valves mounted to said pump body to close said plurality of fuel delivery passages, respectively, corresponding in number to said plurality of fuel delivery passages; and means for controlling said actuator and said plurality of solenoid valves.

9. A fuel injection system as recited in claim 8, further comprising means for providing a fuel return passage having one end connected to said means for providing said fuel supply passage.

* * * * *